US010634319B2

(12) United States Patent
Ji et al.

(10) Patent No.: US 10,634,319 B2
(45) Date of Patent: Apr. 28, 2020

(54) STRIP-SHAPED LED INTERCONNECTED HIGH-VOLTAGE LAMP

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Feng Ji, Zhejiang (CN); Zhaoyong Zheng, Zhejiang (CN); Junjun Ying, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/182,208

(22) Filed: Nov. 6, 2018

(65) Prior Publication Data

US 2019/0162393 A1 May 30, 2019

(30) Foreign Application Priority Data

Nov. 28, 2017 (CN) ..... 2017 1 1211838

(51) Int. Cl.
*F21V 19/00* (2006.01)
*F21V 23/00* (2015.01)
(Continued)

(52) U.S. Cl.
CPC ..... *F21V 19/0045* (2013.01); *F21V 23/002* (2013.01); *F21V 23/06* (2013.01);
(Continued)

(58) Field of Classification Search
None
See application file for complete search history.

(56) References Cited

U.S. PATENT DOCUMENTS 4,053,194 A * 10/1977 Gilman ..... H01R 25/145 439/115
6,033,239 A * 3/2000 Jaakkola ..... H01R 25/145 439/121

(Continued)

*Primary Examiner* — Tho D Ta
(74) *Attorney, Agent, or Firm* — Wang Law Firm, Inc.

(57) ABSTRACT

A strip-shaped LED interconnected high-voltage lamp comprising an assembly groove, a lamp cover, a connector assembly, and a light source assembly. The assembly groove includes two wire assembly grooves. The wire assembly groove is curved and the central angle of the arc is greater than 180 degrees. The lamp cover is integrally formed with the assembly groove. The connector assembly includes a connector body that is inserted into the assembly groove, and two conductive sheets that are fixedly disposed in the connector body. The length of the conductive sheet in the extending direction of the assembly groove is greater than the length of the connector body and protrudes from both ends of the connector body. The conductive sheet coincides with a central axis of the wire assembly groove in an extending direction of the assembly groove. The strip-shaped LED interconnected high-voltage lamp provided by the invention can realize interconnection and can directly connect to high voltage electricity, so that the application range thereof is wide. At the same time, due to the structural arrangement of the assembly groove, the connector assembly, and the light source assembly, and the assembly of different fasteners of the strip-shaped LED interconnected high-voltage lamp can be completed.

10 Claims, 3 Drawing Sheets

(51) Int. Cl.

| | |
|---|---|
| ***F21V 23/06*** | (2006.01) |
| *F21Y 103/10* | (2016.01) |
| *F21Y 115/10* | (2016.01) |
| *H01R 25/14* | (2006.01) |
| *F21V 21/005* | (2006.01) |
| *F21S 4/28* | (2016.01) |

(52) U.S. Cl.
CPC ..... *F21S 4/28* (2016.01); *F21V 19/003* (2013.01); *F21V 21/005* (2013.01); *F21Y 2103/10* (2016.08); *F21Y 2115/10* (2016.08); *H01R 25/145* (2013.01)

(56) References Cited

U.S. PATENT DOCUMENTS 8,186,847 B2 * 5/2012 Hu ..... F21V 21/005 362/225
10,113,721 B1 * 10/2018 Lin ..... F21V 19/0045

* cited by examiner

STRIP-SHAPED LED INTERCONNECTED HIGH-VOLTAGE LAMP

CROSS-REFERENCE TO A RELATED APPLICATION

This application claims priority to a Chinese Patent Application No. CN 201711211838.5, filed on Nov. 28, 2017.

FIELD OF THE TECHNOLOGY

The present invention relates to lighting system, with particular emphasis on a strip-shaped LED interconnected high-voltage lamp.

BACKGROUND

In general daily life, various lighting devices can be seen everywhere, such as fluorescent lamps, street lamps, table lamps, art lamps, and the like. In the above lighting apparatus, a tungsten filament bulb is conventionally used as a light source. In recent years, due to the rapid development of technology, light-emitting diodes (LEDs) have been used as sources of illumination. In addition, in addition to lighting equipment, for general traffic signs, billboards, lights, etc., also use LEDs as a light source. As mentioned above, the use of light-emitting diodes as light-emitting sources has the advantages of power saving and greater brightness, so it has gradually become common in use. Among the existing LED lamps, many strip lamps, especially LED strip lamps, require additional power supply outside the lamps due to the low voltage characteristics of the LED chips. It is because of the extra power supply that makes the interconnection difficult because the lamps can be interconnected, but if the power supply is to be interconnected, it will cause many problems, such as safety problems, voltage drop problems, etc., so that the interconnection installation of LED strip lamp complex and reduce the safety degree.

SUMMARY OF THE INVENTION

Therefore, the present invention provides an optimized strip-shaped LED interconnected high-voltage lamp to solve the above problem.

A strip-shaped LED interconnected high-voltage lamp, wherein the input voltage of the strip-shaped LED interconnected high-voltage lamp is high-voltage electricity, characterized in that: the strip-shaped LED interconnected high-voltage lamp comprises an assembly groove, and a lamp cover disposed on the assembly groove, a connector assembly disposed at one end of the assembly groove, and a light source assembly disposed in the assembly groove, the assembly groove including two wire assembly grooves respectively arranged on two side walls of the assembly groove in a cross section perpendicular to an extending direction of the assembly groove, the wire assembly groove is curved and the central angle of the arc is greater than 180 degrees, the lamp cover is integrally formed with the assembly groove, and the connector assembly includes a connector body inserted on the assembly groove, and two conductive sheets fixedly disposed in the connector body, the length of the conductive sheet in the extending direction of the assembly groove is greater than the length of the connector body and extending from the two ends of the connector body, the conductive sheet coincides with a central axis of the wire assembly groove in an extending direction of the assembly groove, and both ends of the conductive sheet respectively include a trapezoidal end portion, the light source assembly consists of two wire rods which are inserted respectively in the wire assembly groove, the short side of the trapezoidal end portion is located at the free end of the conductive sheet and is adjacent to the wire rod.

Advantageously, the assembly groove further includes two light source assembly grooves disposed on the two side walls of the assembly groove, and the light source assembly grooves are spaced apart from the wire assembly grooves on the same side walls of the assembly groove.

Advantageously, the minimum distance between the light source assembly groove and the wire assembly groove is greater than 6.5 mm.

Advantageously, the lamp cover and the assembly groove are manufactured by a two-color extrusion process.

Advantageously, the lamp cover is made of optically permeable materials.

Advantageously, the assembly groove is made of a polycarbonate material.

Advantageously, the assembly groove further includes two connector assembly grooves respectively disposed on the two side walls of the assembly groove, and two step portions formed between the lamp cover and the free ends of the two side walls of the assembly groove, each of the side walls of the connector body includes two connector walls, the connector assembly groove and the step portion are interposed between the two connector walls.

Advantageously, the connector body includes two spaced apart conductor assembly grooves, and the two conductor assembly grooves include a partition wall, a snap arc disposed on the free end of the partition wall, and two grooves respectively arranged on the inner side wall of the connector body, the groove is spaced apart from the partition wall, and the two conductor assembly grooves are respectively configured to insert the conductive sheet.

Advantageously, the conductive sheet includes a notch, and a portion of the conductive sheet having the notch is interposed in the conductor assembly groove.

Advantageously, the connector assembly groove and the step portion are respectively disposed on both sides of the light source assembly groove and the wire assembly groove in a section perpendicular to the extending direction of the assembly groove.

Compared with the prior art, the strip-shaped LED interconnected high-voltage lamp provided by the invention can realize interconnection and can directly connect to high voltage electricity, so that the application range thereof is wide. At the same time, due to the structural arrangement of the assembly groove, the connector assembly, and the light source assembly, and the assembly of different fasteners of the strip-shaped LED interconnected high-voltage lamp can be completed.

DETAILED DESCRIPTION OF THE DRAWINGS

The drawings described herein are intended to promote a further understanding of the present invention, as follows.

DESCRIPTION OF THE PREFERRED EMBODIMENTS

The present application is illustrated by way of the following detailed description based on of the accompanying drawings. It should be noted that illustration to the embodiment in this application is not intended to limit the invention.

Figure 1:
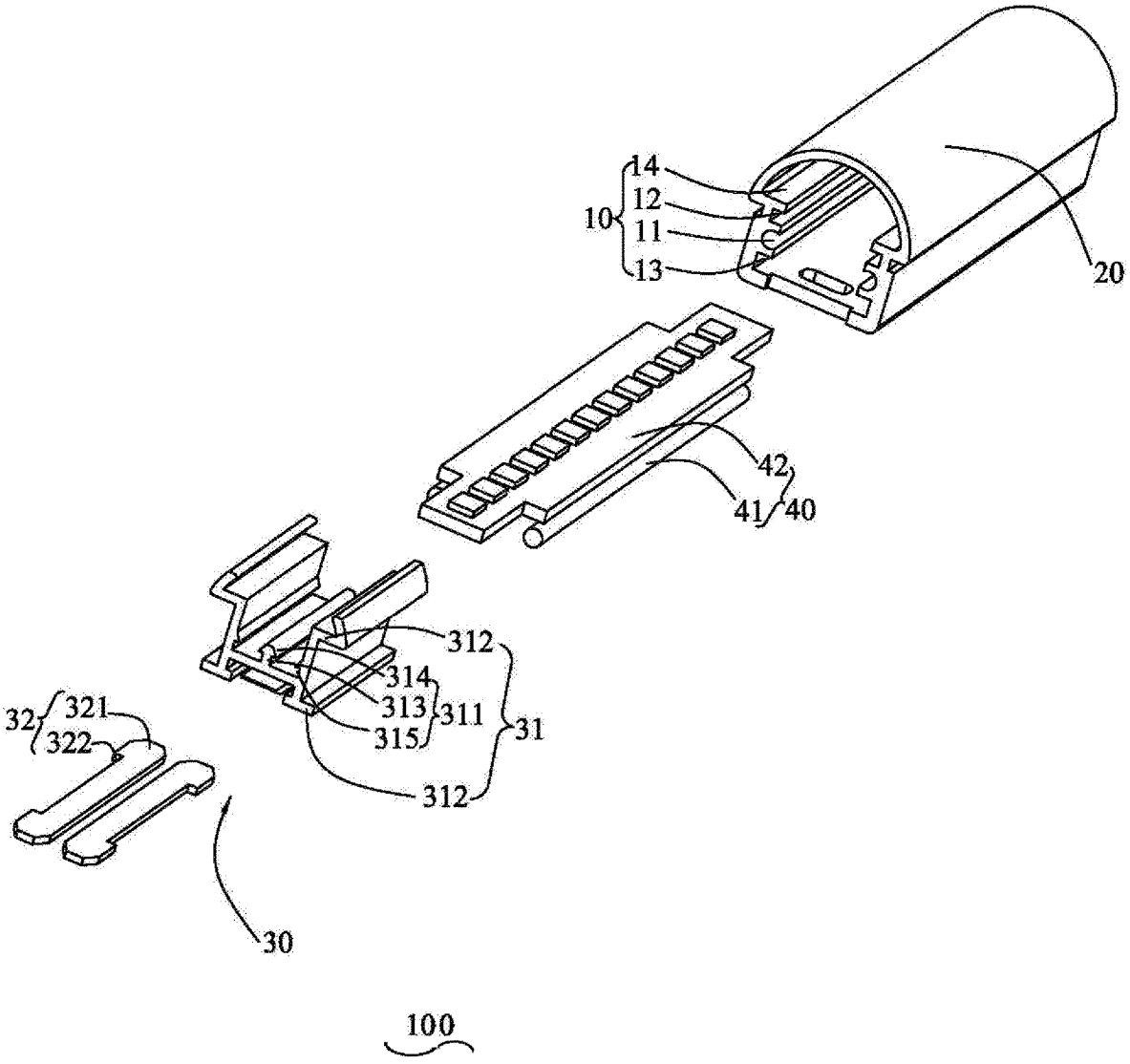
FIG. 1 is a schematic exploded view of a strip-shaped LED interconnected high-voltage lamp provided by the present invention.
Figure 2:
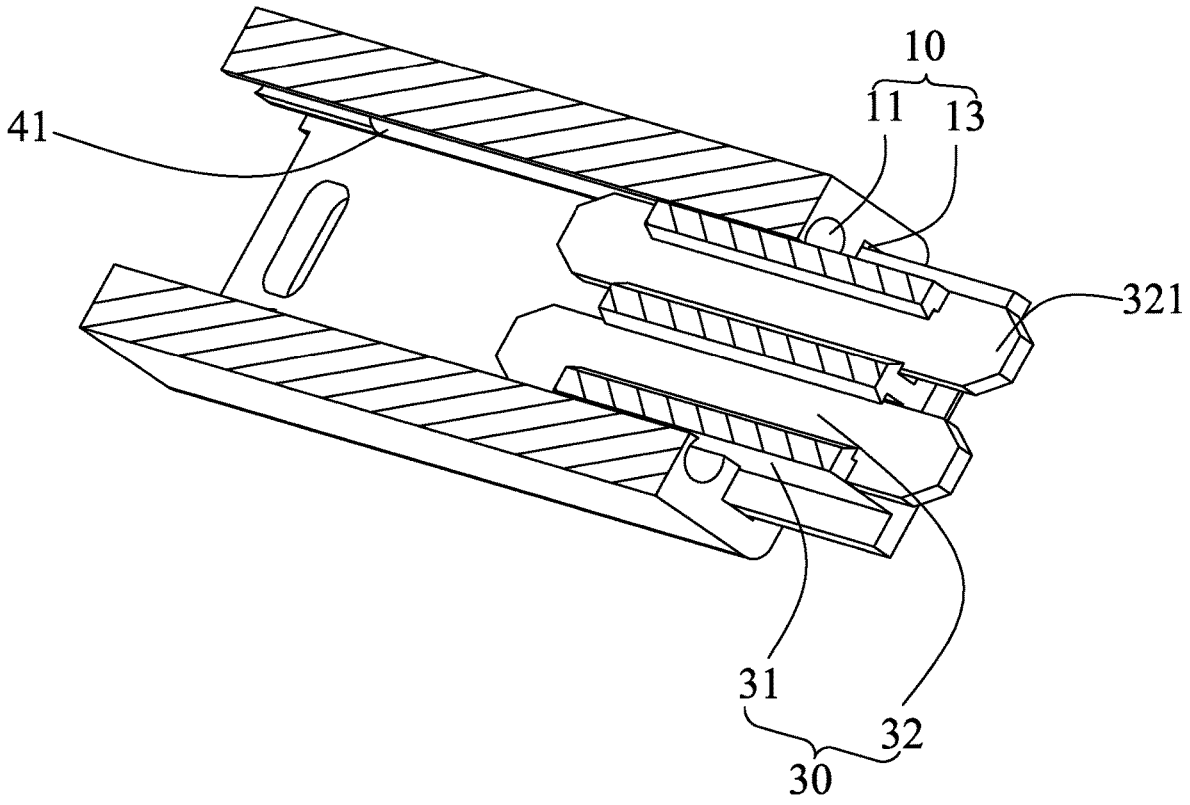
FIG. 2 is a cross-sectional structural view of the strip-shaped LED interconnected high-voltage lamp of FIG. 1 along its extending direction.
Figure 3:
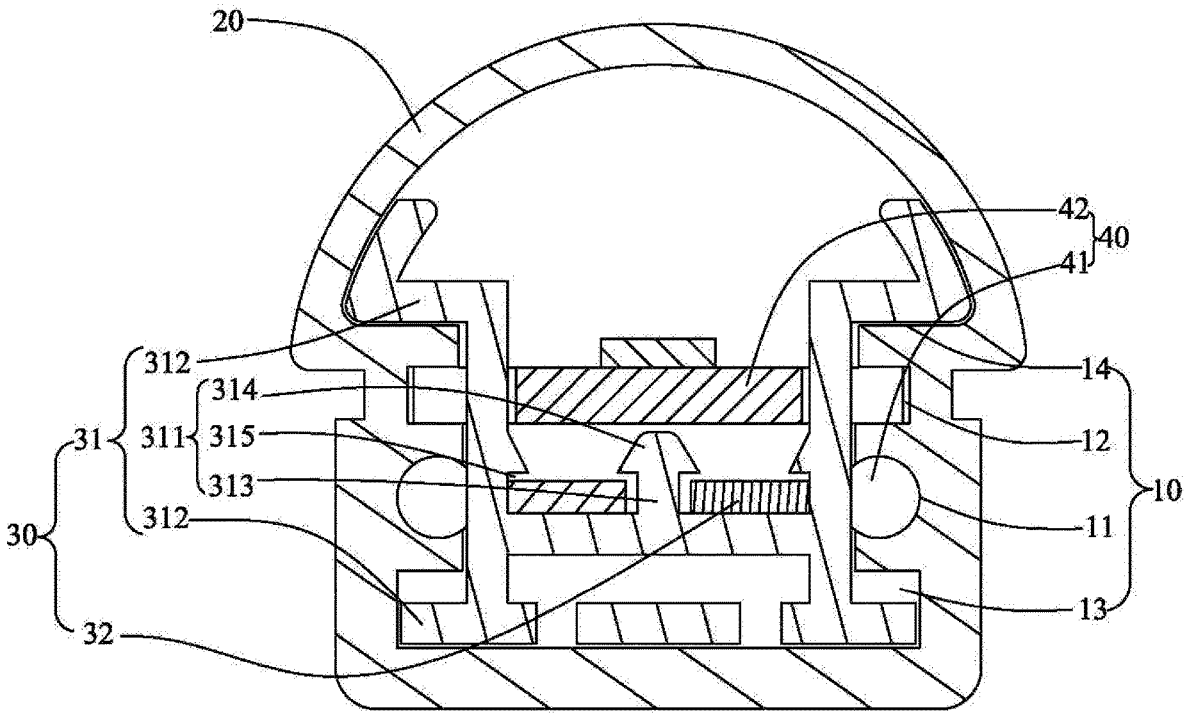
FIG. 3 is a schematic cross-sectional view of the strip-shaped LED interconnected high-voltage lamp of FIG. 1 along a direction perpendicular to the direction in which it extends.

Please refer to FIG. 1 to FIG. 3, which are schematic structural diagrams of a strip-shaped LED interconnected high-voltage lamp 100 according to the present invention. The input voltage of the strip-shaped LED interconnected high-voltage lamp 100 is high-voltage electricity. Therefore, according to the safety requirements of various countries, the high-voltage lamp needs a high creep distance, an insulation coefficient, and a safety rule for passing current, etc., of course, the above-mentioned security requirements can be found in the standards of various countries, and should be known to those skilled in the art, and will not be described in detail herein. In addition, it is well known that for LED chips, the rated voltage is generally low, such as 24V or 12V, etc., and if the lamp using the LED chip is directly connected to the high voltage, many improvements are needed for the lamp. The strip-shaped LED interconnected high-voltage lamp 100 includes an assembly groove 10, a lamp cover 20 disposed on the assembly groove 10, a connector assembly 30 disposed at one end of the assembly groove 10, and a light source assembly 40 disposed in the assembly groove 10. It is conceivable that the strip-shaped LED interconnected high-voltage lamp 100 further includes other functional modules, such as front and rear end caps, mounting components, etc., which should be known to those skilled in the art, and no longer List and explain in detail.

The assembly groove 10 is a strip-shaped structure and includes two wire assembly grooves 11 respectively disposed on the two side walls of the assembly groove 10 in a section perpendicular to the extending direction of the assembly groove 10, two light source assembly groove 12 respectively disposed on the two side walls of the assembly groove 10, two connector assembly grooves 13 respectively disposed on the two side walls of the assembly groove 10, and two step portion 14 formed between the lamp cover 20 and free ends of the two side walls of the assembly groove 10. The wire assembly groove 11 is curved and the central angle of the arc is greater than 180 degrees. The reason why the wire assembly groove 11 is set to have a central angle of more than 180 degrees will be described in detail below in conjunction with the connector assembly 30. The light source assembly groove 12 is used to assemble the light source assembly 40. On the same side wall of the assembly groove 10, the light source assembly groove 12 and the wire assembly groove 11 should be separated. As for the distance between the light source assembly groove 12 and the wire assembly groove 11 on the same side wall, it can be set according to actual conditions, because the input high voltages of different countries are different, for example, China is 220 volts, and the United States is 110 volts, thus resulting in different safety standards. In this embodiment, the minimum distance between the light source assembly groove 12 and the wire assembly groove 11 is greater than 6.5 mm. The connector assembly groove 13 is used together with the step portion 14 for assembling the connector assembly 30, so that the connector assembly groove 13 and the step portion 14 are separated, and in a section perpendicular to the extension direction of the assembly groove 10 the connector assembly groove 13 and the step portion 14 are respectively disposed on both sides of the light source assembly groove 12 and the wire assembly groove 11.

The lamp cover 20 is integrally formed with the assembly groove 10 to improve the electrical isolation performance of the strip-shaped LED interconnected high-voltage lamp 100 as a whole, so that the cross-sectional area of the lamp cover 20 and the assembly groove 10 can be made smaller. The lamp cover 20 may be made of optically permeable materials, and the assembly groove 10 may be made of a polycarbonate material. Therefore, when the lamp cover 20 and the assembly groove 10 are integrally formed, it can be manufactured by a two-color extrusion process. The cross-sectional shape of the lamp cover 20 can be set according to actual conditions, such as a rectangular groove, an arc groove, or the like. In this embodiment, the lamp cover 20 is an arc groove.

The connector assembly 30 includes a connector body 31 that is inserted into the assembly groove 10, and two conductive sheets 32 that are fixedly disposed in the connector body 31. The connector body 31 is fixedly inserted into the assembly groove 10 and includes two spaced apart conductor assembly grooves 311 and two spaced apart connector walls 312. When the connector body 31 is inserted into the assembly groove 10, one of the two connector walls 312 is inserted in the connector assembly groove 13 and the other of the two connector walls 312 is latched in the step portion 14, thereby fixing the connector body 31 in the assembly groove 10. It is conceivable that, in order to fix the connector body 31, the dimensions of the respective structures of the connector body 31, such as the size and distance of the connector wall 312 should be the same as the size and distance of the connector assembly groove 13 of the assembly groove 10 and the step portion 14. The two conductor assembly grooves 311 include a partition wall 313, a snap arc 314 disposed on the free end of the partition wall 313, and two grooves 315 respectively disposed on the inner sidewalls of the connector body 31. The groove 315 is spaced apart from the partition wall 313 for inserting the conductive sheet 32. The length of the conductive sheet 32 is greater than the length of the connector body 31 along the extending direction of the assembly groove 10, while the conductive sheet 32 protrudes from both ends of the connector body 31 for electrically connecting to the light source assembly 40. In order to electrically connect the conductive sheet 32 to the light source assembly 40 when the connector assembly 30 is inserted into the assembly groove 10, the conductive sheet 32 and The central axes of the assembly grooves 11 are coincident in the extending direction of the assembly groove 10, such that the conductive sheets 32 can be electrically connected to the light source assembly 40 when the connector assembly 30 is inserted into the assembly groove 10. Both ends of the conductive sheet 32 respectively include a trapezoidal end portion 321, and the short side of the trapezoidal end portion 321 is located at the free end of the conductive sheet 32. The specific function of the trapezoidal end portion 321 will be described in detail below with the light source assembly 40. The conductive sheet 32 further includes a gap 322. The gap 322 is vacant in the conductor assembly groove 311, and the width of the conductor assembly groove 311 along the extension direction perpendicular to the assembly groove 10 is equal to the width of the conductive sheet 32 at the gap 322, thereby the conductive sheet 32 can be prevented from moving from the conductor assembly groove 311 in the extending direction of the assembly groove 10. When the conductive sheet 32 is assembled, one side of the conductive sheet 32 should first be inserted into the groove 315 and the other side of the conductive sheet 32 abutted against the partition wall 313. Then, the conductive sheet 32 is pressed to be plastically deformed to be pressed into the conductor assembly groove 311. It is conceivable that when the conductive sheet 32 is pressed into the conductor assembly groove 311, the conductive sheet 32 will be restored.

The light source assembly 40 includes two wire rods 41 respectively inserted in the wire assembly grooves 11 and a circuit board 42 interposed in the light source assembly grooves 12. It is conceivable that the LED chips can be placed directly on the circuit board 42. The wire rod 41 should be circular because the central angle of the wire assembly groove 11 is greater than 180 degrees, so that the wire rod 41 does not fall off the wire assembly groove 11, and can also be electrically connected to the conductive sheet 32. The wire rod 41 can be made of copper and its diameter should meet the safety requirements of various countries. The trapezoidal end portion 321 of the conductive sheet 32 and the wire rod 41 are adjacent to each other. When the connector assembly 30 is inserted into the assembly groove 10, the wire rod 41 first contacts the trapezoidal end portion 321 of the conductive sheet 32, and during the insertion of the connector assembly 30, due to the abutment of the wire rod 41, and because the conductive sheet 32 coincides with the central axes of the wire assembly groove 11 in the extending direction of the assembly groove 10, so that the ends of the two conductive sheets 32 will be deformed, so that the conductive sheets 32 are in good contact with the wire rods 41, avoiding separation, and also because of the restoring force of the conductive sheets 32, so that the connector assembly 30 is better secured in the assembly groove 10 for the purpose of fixed assembly and is secured without fasteners.

Compared with the prior art, the strip-shaped LED interconnected high-voltage lamp 100 provided by the invention can realize interconnection and can directly connect to high voltage electricity, so that the application range thereof is wide. At the same time, due to the structural arrangement of the assembly groove 10, the connector assembly 30, and the light source assembly 40, and the assembly of different fasteners of the strip-shaped LED interconnected high-voltage lamp 100 can be completed.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

The invention claimed is:

1. A strip-shaped LED interconnected high-voltage lamp, wherein an input voltage of the strip-shaped LED interconnected high-voltage lamp is high-voltage electricity, comprising:

an assembly groove, and a lamp cover disposed on the assembly groove, a connector assembly disposed at one end of the assembly groove, and a light source assembly disposed in the assembly groove, the assembly groove including two wire assembly grooves respectively arranged on two side walls of the assembly groove in a cross section perpendicular to an extending direction of the assembly groove, the wire assembly groove is curved and a central angle of arcs of the wire assembly grooves is greater than 180 degrees, the lamp cover is integrally formed with the assembly groove, and the connector assembly includes a connector body inserted on the assembly groove, and two conductive sheets fixedly disposed in the connector body, wherein a length of the conductive sheet in the extending direction of the assembly groove is greater than a length of the connector body and extending from two ends of the connector body, the conductive sheet coincides with a central axis of the wire assembly groove in an extending direction of the assembly groove, and both ends of the conductive sheet respectively include trapezoidal end portions, the light source assembly consists of two wire rods corresponding to the two conductive sheets, the wire rods are inserted respectively in the wire assembly grooves, and the trapezoidal end portions of the conductive sheet are adjacent to the corresponding wire rod.

2. The strip-shaped LED interconnected high-voltage lamp as claimed in claim 1, wherein the assembly groove further includes two light source assembly grooves disposed on the two side walls of the assembly groove, and the light source assembly grooves are spaced apart from the wire assembly grooves on the same side walls of the assembly groove.

3. The strip-shaped LED interconnected high-voltage lamp as claimed in claim 2, wherein the minimum distance between the light source assembly groove and the wire assembly groove is greater than 6.5 mm.

4. The strip-shaped LED interconnected high-voltage lamp as claimed in claim 1, wherein the lamp cover and the assembly groove are manufactured by a two-color extrusion process.

5. The strip-shaped LED interconnected high-voltage lamp as claimed in claim 4, wherein the lamp cover is made of optically permeable materials.

6. The strip-shaped LED interconnected high-voltage lamp as claimed in claim 4, wherein the assembly groove is made of a polycarbonate material.

7. The strip-shaped LED interconnected high-voltage lamp as claimed in claim 2, wherein the assembly groove further includes two connector assembly grooves respectively disposed on the two side walls of the assembly groove, and two step portions formed between the lamp cover and free ends of the two side walls of the assembly groove, the connector body includes two connector walls, the connector assembly groove and the step portion are interposed between the two connector walls.

8. The strip-shaped LED interconnected high-voltage lamp as claimed in claim 1, wherein the connector body includes two spaced apart conductor assembly grooves, and the two conductor assembly grooves include a partition wall, a snap arc disposed on a free end of the partition wall, and two grooves respectively arranged on an inner side wall of the connector body, the groove is spaced apart from the partition wall, and the two conductor assembly grooves are respectively configured to insert the conductive sheet.

9. The strip-shaped LED interconnected high-voltage lamp as claimed in claim 8, wherein the conductive sheet includes a notch, and a portion of the conductive sheet having the notch is interposed in the conductor assembly groove.

10. The strip-shaped LED interconnected high-voltage lamp as claimed in claim 7, wherein the connector assembly groove and the step portion are respectively disposed on both sides of the light source assembly groove and the wire assembly groove in a section perpendicular to the extending direction of the assembly groove.

* * * * *